US005651469A

United States Patent [19]

Lodge

[11] Patent Number: 5,651,469

[45] Date of Patent: Jul. 29, 1997

[54] GARMENT RACK ASSEMBLY

[75] Inventor: Reginald A. Lodge, Wheaton, Ill.

[73] Assignee: Richards-Wilcox, Inc., Aurora, Ill.

[21] Appl. No.: 431,017

[22] Filed: Apr. 28, 1995

Related U.S. Application Data

[63] Continuation-in-part of Ser. No. 36,094, Mar. 13, 1995.

[51] Int. Cl.[6] ..... A47F 7/00

[52] U.S. Cl. ..... 211/189

[58] Field of Search ..... 211/189, 190, 211/122, 123, 124, 208; 312/198, 199, 200, 201

[56] References Cited

U.S. PATENT DOCUMENTS

| | | | |
|---|---|---|---|
| 732,670 | 6/1903 | Watkins et al. | 312/200 X |
| 769,024 | 8/1904 | Ryan | 211/94 |
| 851,033 | 4/1907 | Rountree | 312/199 X |
| 859,860 | 7/1907 | Weir | 211/123 |
| 1,695,517 | 12/1928 | Waldbauer | 211/124 |
| 2,056,544 | 10/1936 | Vanderveld | 211/123 |
| 2,202,427 | 5/1940 | Polen | 312/287 X |
| 2,347,892 | 5/1944 | Derman | 211/123 X |
| 2,633,979 | 4/1953 | Warnick | 211/123 X |
| 2,639,816 | 5/1953 | Fogg | 211/123 X |
| 2,685,491 | 8/1954 | Bulow | 211/123 X |
| 2,822,093 | 2/1958 | Graci | 211/124 |
| 3,288,308 | 11/1966 | Gingher | 211/123 |
| 3,944,309 | 3/1976 | Taniwaki | 312/200 X |
| 4,017,131 | 4/1977 | Camenisch . | |
| 4,061,379 | 12/1977 | Randall . | |
| 4,079,840 | 3/1978 | Usner | 211/124 |
| 4,139,248 | 2/1979 | Hornbacher . | |
| 4,153,312 | 5/1979 | Taniwaki . | |
| 4,261,626 | 4/1981 | Hornbacher . | |
| 4,494,896 | 1/1985 | Di Franco | 211/123 X |
| 4,789,210 | 12/1988 | Weiss et al. . | |
| 4,979,785 | 12/1990 | Richards . | |
| 5,069,513 | 12/1991 | Farrell et al. . | |
| 5,160,189 | 11/1992 | Johnston et al. . | |
| 5,160,190 | 11/1992 | Farrell et al. . | |
| 5,207,335 | 5/1993 | Voelz . | |
| 5,285,910 | 2/1994 | Chen | 211/122 X |

*Primary Examiner*—Alvin C. Chin-Shue
*Assistant Examiner*—Sarah L. Purol
*Attorney, Agent, or Firm*—Pearne, Gordon, McCoy & Granger LLP

[57] ABSTRACT

A movable aisle rack system is provided for storing hanging garments which includes a plurality of laterally movable racks. The movable racks have longitudinally extending garment supports and enclosures for protecting the garments. The enclosures have uprights and shelves supported by shelf supports attached to the uprights. The garment supports longitudinally extend between the uprights to hang and remove the garments through open lateral sides of the enclosure. In a partially closed configuration the garment supports are inverted shelf supports located at the open lateral sides such that the garments partially extend out of the open lateral sides of the enclosure. Base extensions of the movable racks laterally extend beyond the garments to prevent contact of the garments laterally extending out of the enclosures with an adjacent rack. In a fully closed configuration the garment supports are hanger rods located at the lateral center of the enclosure such that the garments supported by the hanging rods are completely within the enclosure. Hanger assemblies are provided which each include a pair of parallel and spaced a part support members, one of the hanger rods perpendicular to and supported by the support members, and a pair of parallel and spaced a part shelf supports perpendicular to and supporting ends of the support members. A shelf is supported by the pair of shelf supports above the hanger rod.

19 Claims, 6 Drawing Sheets

GARMENT RACK ASSEMBLY

BACKGROUND OF THE INVENTION

This is a Continuation-In-Part of prior application Ser. No. 29/036,094, filed Mar. 13, 1995.

FIELD OF THE INVENTION

The present invention relates in general to a movable aisle rack system, and more particularly, to a movable aisle rack system for storing hanging garments.

DESCRIPTION OF RELATED ART

Movable aisle rack or storage systems are well-known in which groups of racks are arranged for movement along a bay so as to define a loading or unloading aisle or space between any two of the racks. For examples of movable aisle storage systems see U.S. Pat. Nos. 5,160,190, 5,160,189, 5,069,513, and 4,017,131, the disclosures of which are expressly incorporated herein in their entirety by reference. The racks of the storage systems are shelving units. Further, U.S. Pat. No. 4,153,312, the disclosure of which is expressly incorporated herein in its entirety by reference, discloses a movable aisle storage system having a rack with an open frame in the form of an inverse shadow box. These movable aisle storage systems do not provide efficient and protected storage for hanging garments. Accordingly, there is a need in the art for an improved movable aisle rack system.

SUMMARY OF THE INVENTION

The present invention provides a movable aisle rack system for storing hanging garments. The movable aisle rack system includes a plurality of laterally movable racks, enclosures mounted on the movable racks, and garment supports mounted on the movable racks for supporting the garments. Each of the enclosures has at least one generally horizontal top panel and at least two generally vertical end panels. The garment supports are located such that the garments supported by the garment supports are stored at least partially within the enclosures.

In a preferred embodiment the garment supports are located approximately at open lateral sides of the enclosures such that the garments supported by the garment supports partially extend out of the open lateral sides. The garment supports are preferably inverted shelf supports. Means for spacing the movable racks are preferably provided to prevent contact of the garments laterally extending out of the enclosures with adjacent racks. In another preferred embodiment the garment supports are located approximately at the lateral center of the enclosures such that the garments supported by the garment supports are completely within the enclosure. Hanger assemblies are preferably provide the garment supports which each include a pair of parallel and spaced apart support members, hanger rods perpendicular to and supported by the support members, and a pair of parallel and spaced a part shelf supports perpendicular to and supporting ends of the support members. A shelves preferably supported by the shelf supports above the hanger rods.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
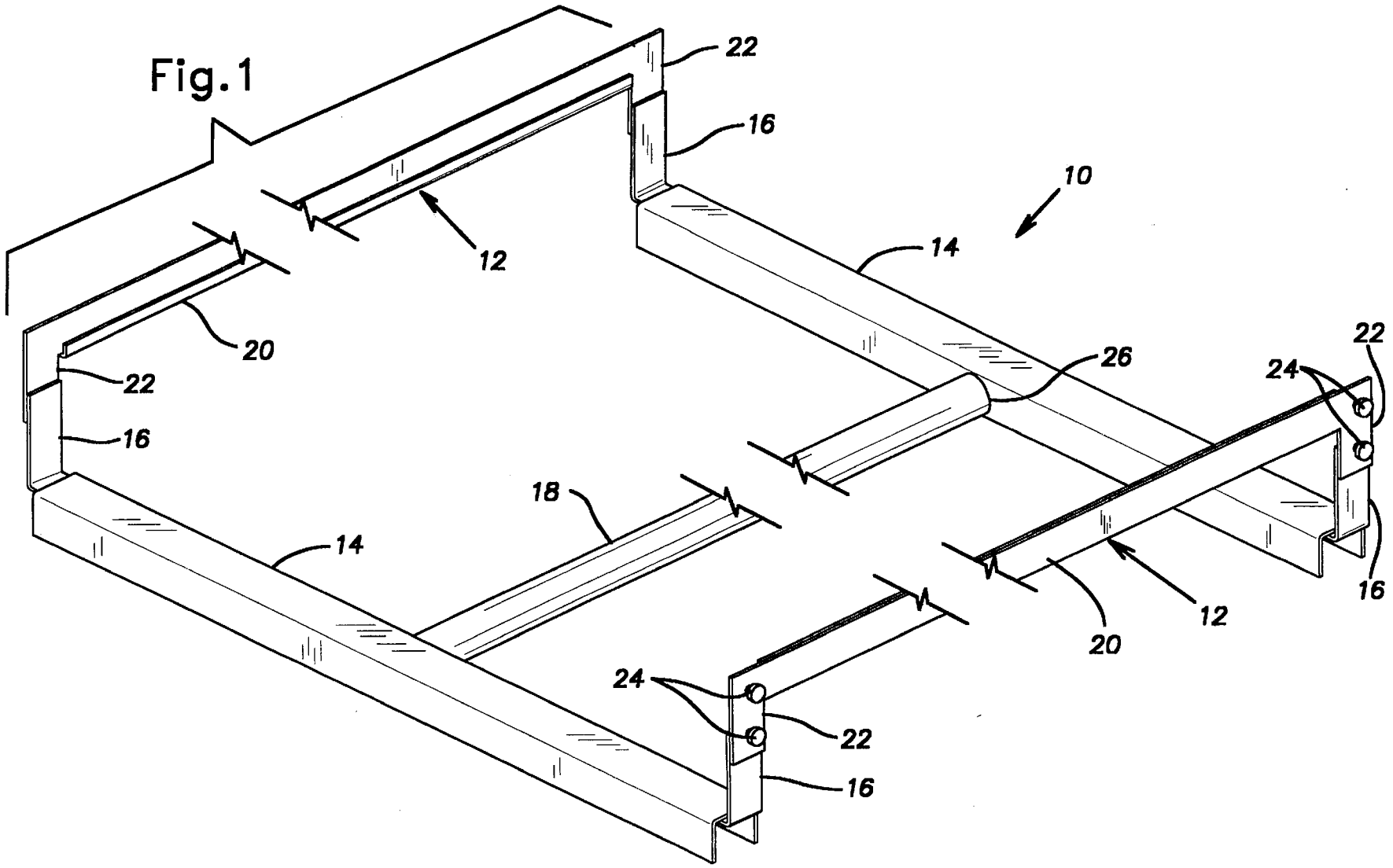
FIG. 1 is a fragmented perspective view of a hanger assembly according to the invention.
Figure 4:
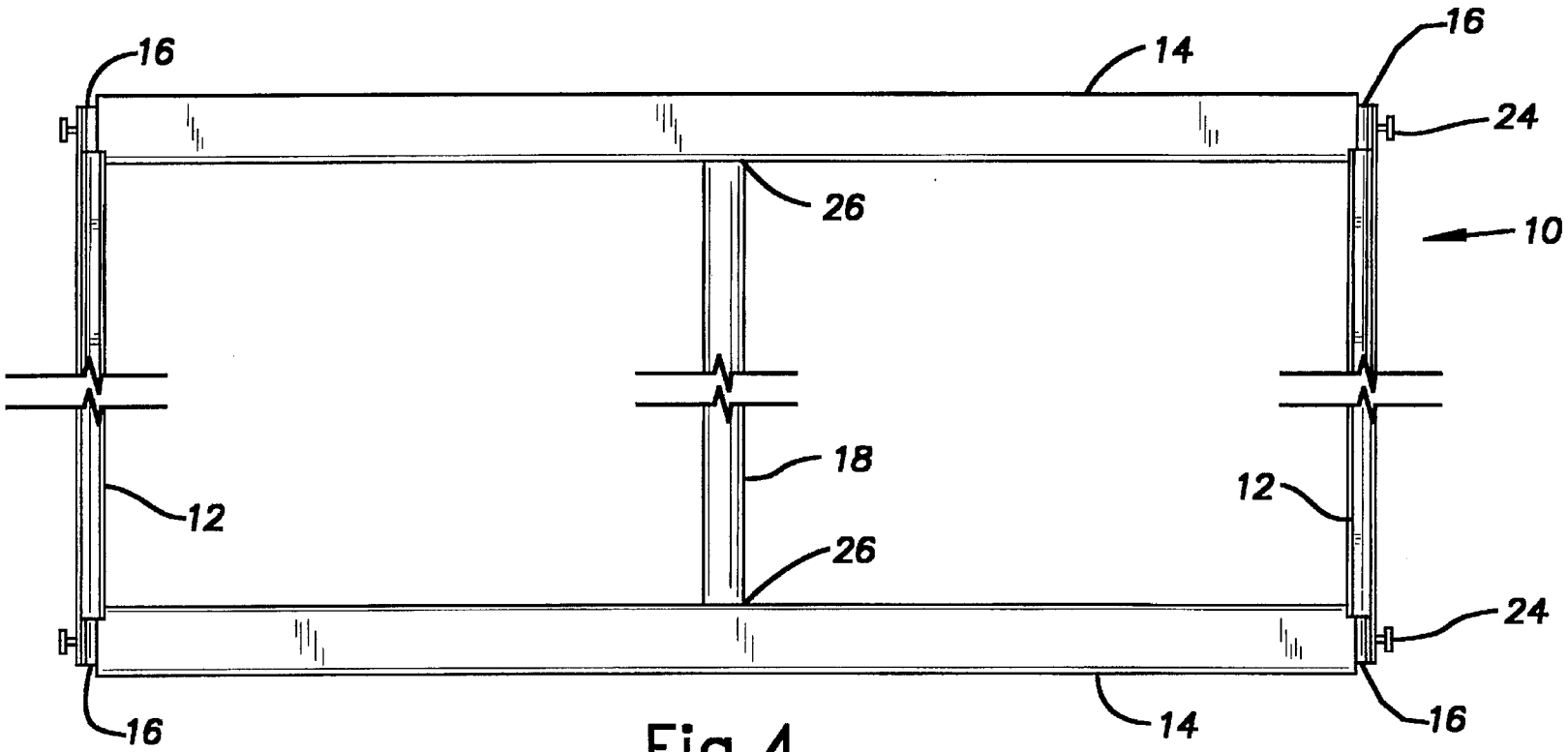
FIG. 4 is a fragmented plan view of the hanger assembly of FIG. 1.
Figure 2:
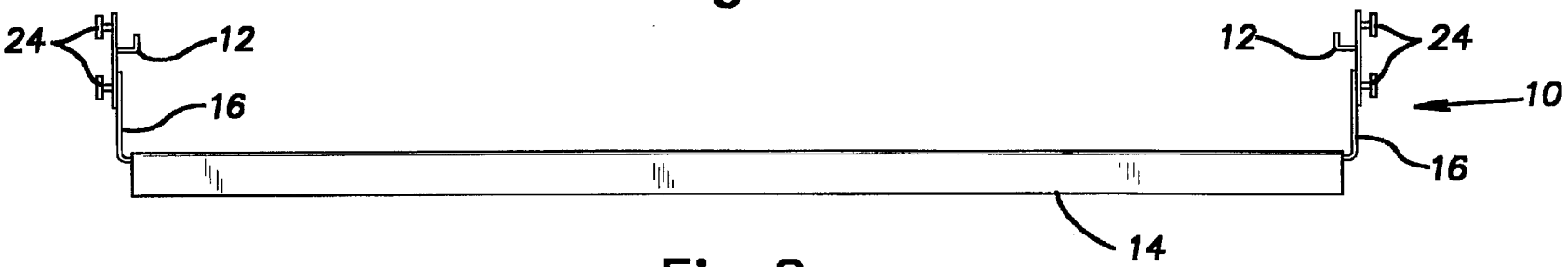
FIG. 2 is an end elevational view of the hanger assembly of FIG. 1.
Figure 3:
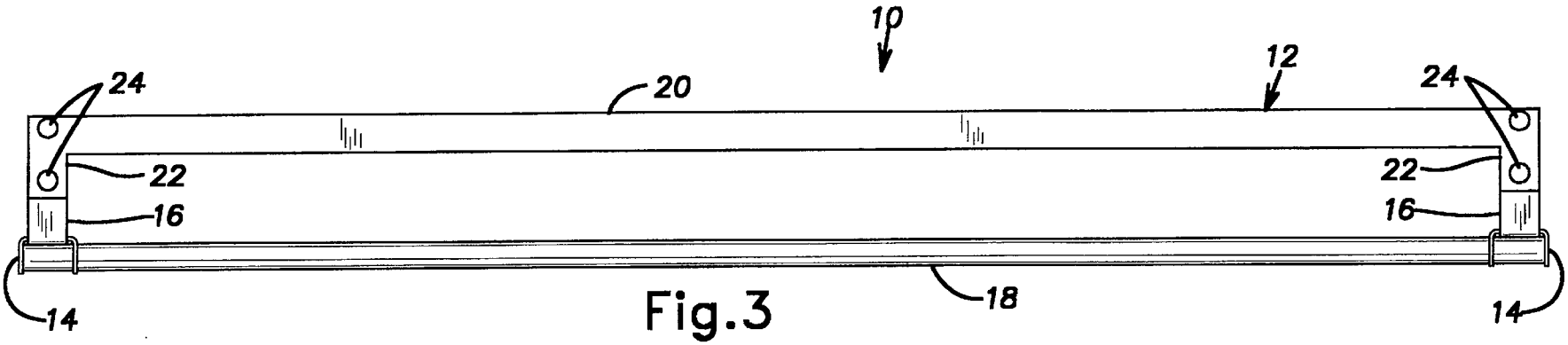
FIG. 3 is a front elevational view of the hanger assembly of FIG. 1.
Figure 5:
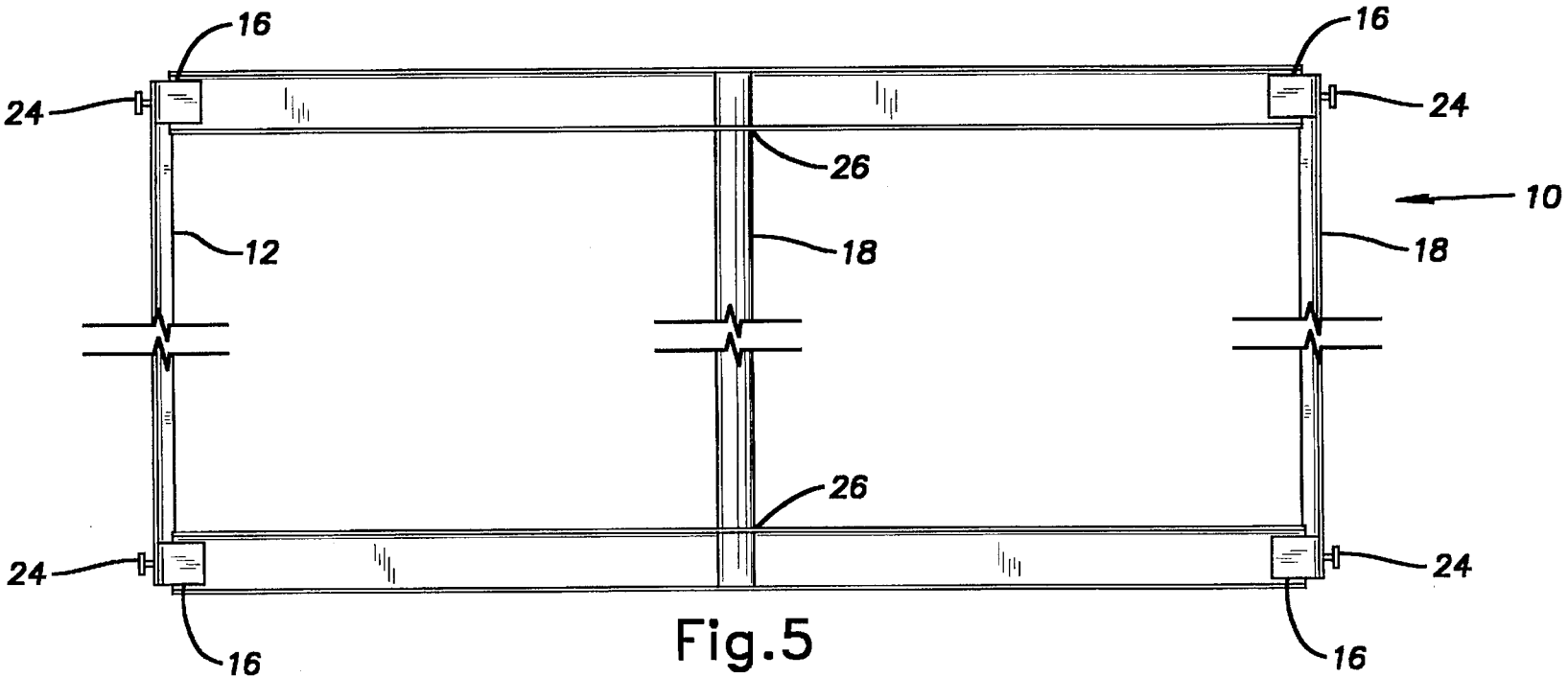
FIG. 5 is a fragmented bottom view of the hanger assembly of FIG. 1.

FIGS. 1 to 5, illustrate a hanger assembly 10 according to the invention including a pair of shelf supports 12, a pair of support members 14, attachment members 16, and a garment support or hanger rod 18. Each shelf support 12 has a central portion 20 which is generally channel-shaped in cross-section and end portions 22 which are planar with one side of the channel-shaped central portion 20. Each shelf support 12 is preferably formed from a metal sheet of suitable material. Each shelf support 12 also has a pair of vertically spaced rivets 24 at each of the end portions 22. The rivets 24 laterally extend from an outer side of the end portions 22 in a direction opposite the channel of the central portion 20.

Figure 6:
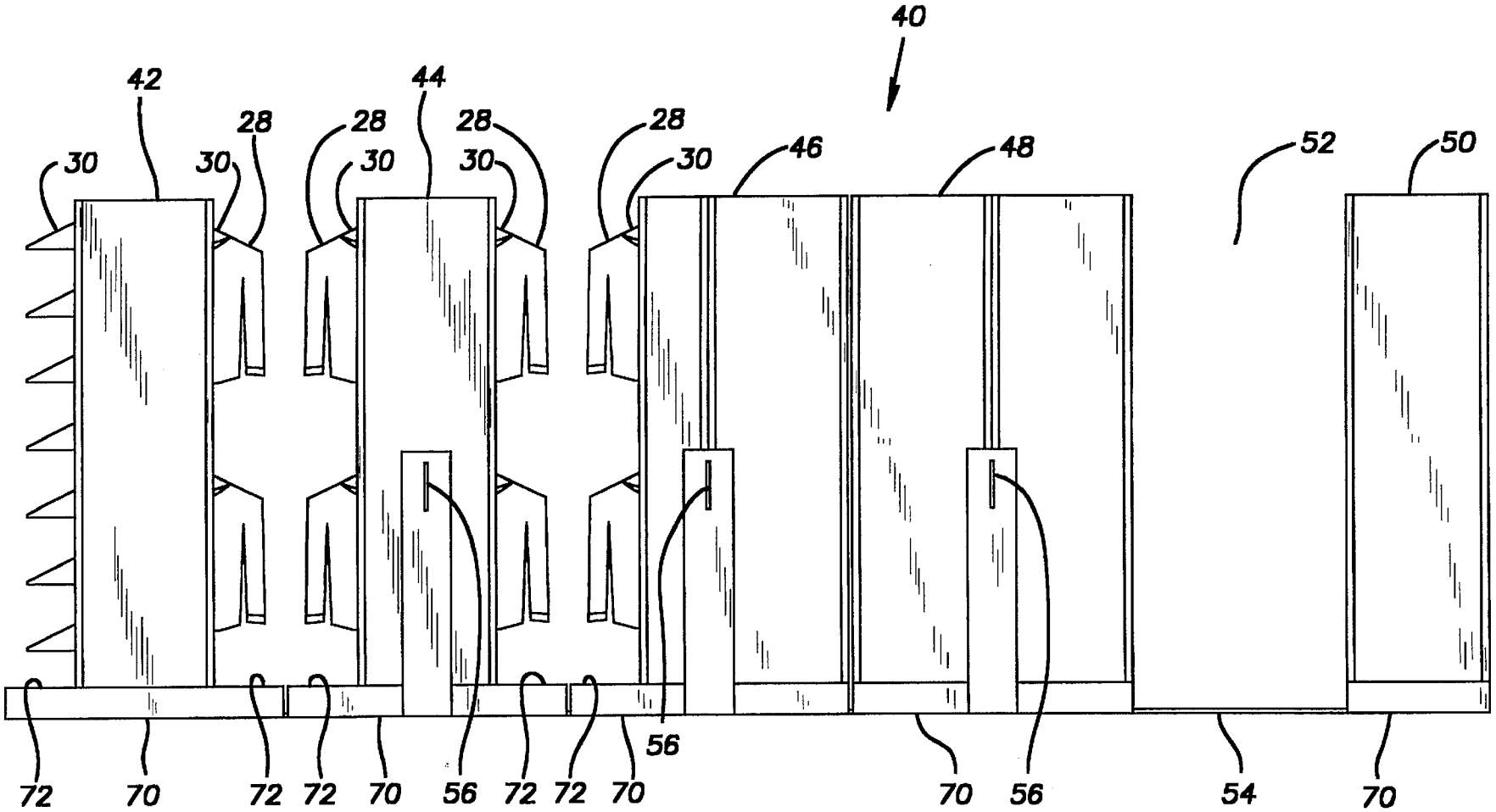
FIG. 6 is an elevational view of a movable aisle garment rack system according to the invention.
Figure 7:
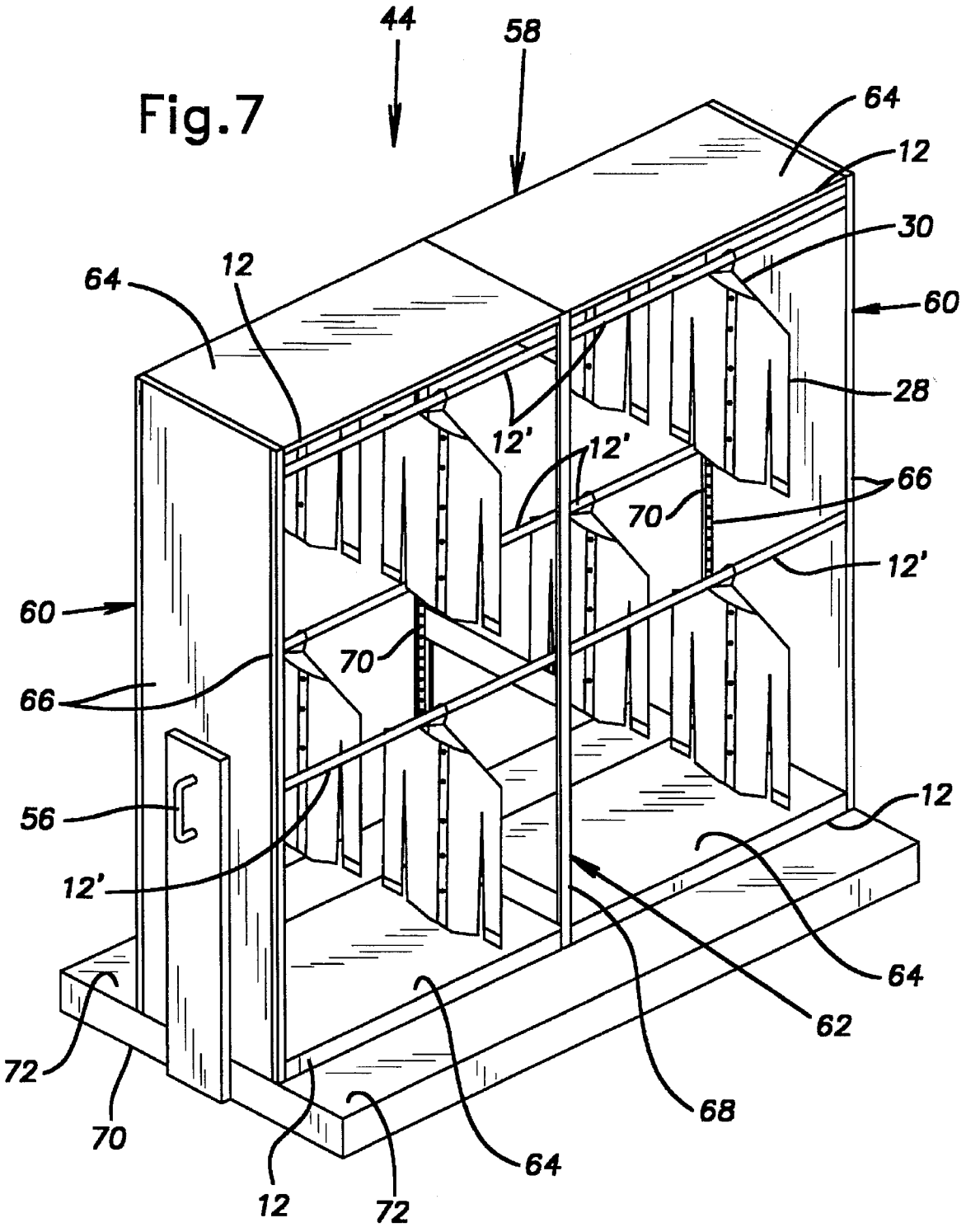
FIG. 7 is a perspective view of a partially closed rack of the movable aisle garment rack system of FIG. 6.
Figure 8:
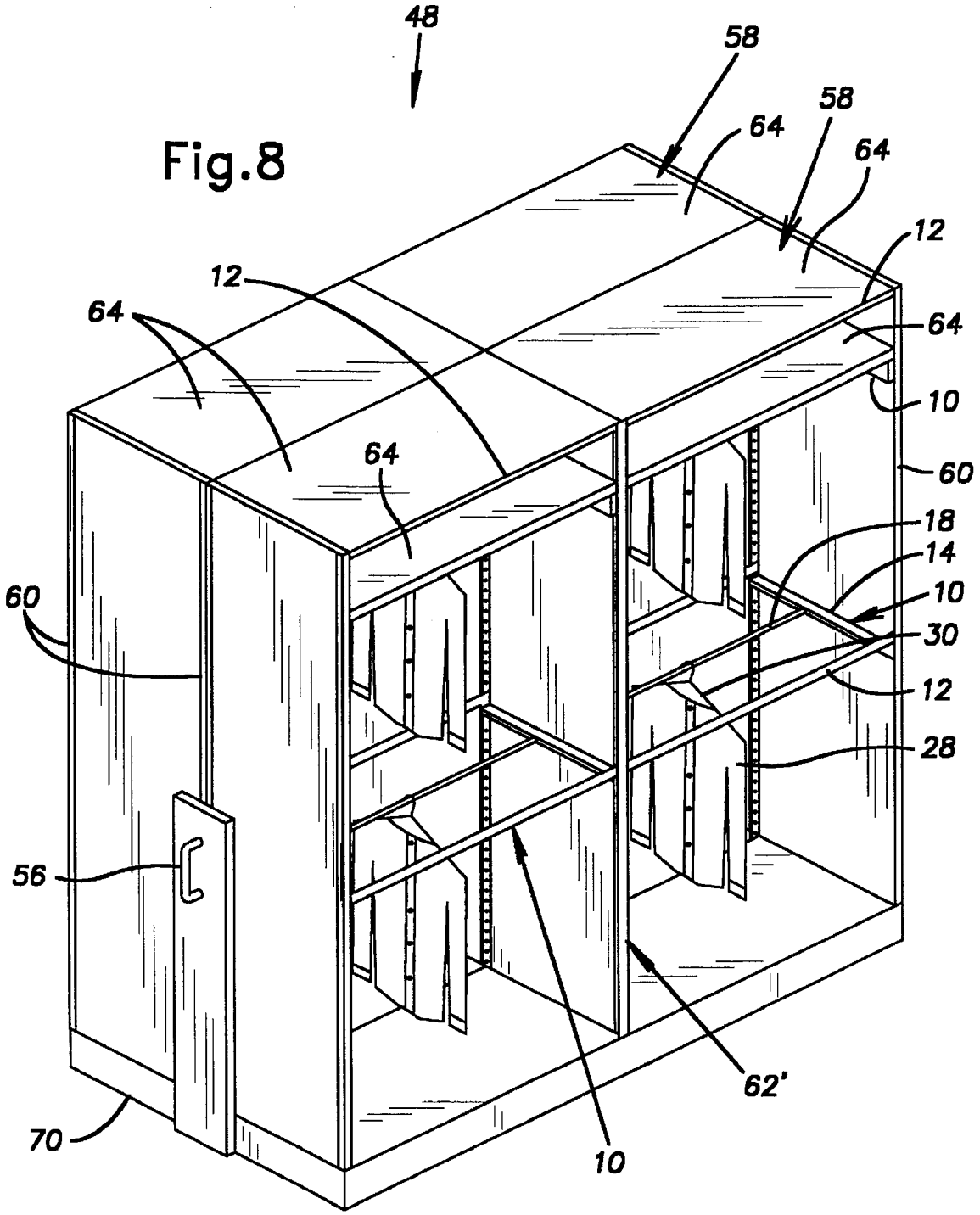
FIG. 8 is a perspective view of closed rack of the movable aisle garment rack system of FIG. 6.

The support members 14 are inverted channels in cross-section having a horizontal portion and vertical portions downwardly extending from ends of the horizontal portion. The support members 14 are generally parallel and spaced apart such that ends of the hanger rod 18 extend into openings 26 in the support members 14 at approximately the center of the support members 14. The hanger rod 18 longitudinally and generally perpendicularly extends between the support members 14 and is supported by the support members 14. The hanger rod 18 can be fixed to the support members 14 such as, for example, by welding or mechanical fasteners. The hanger rod 18 is sized and shaped so that garments 28 can be hung from the hanger rod 18 with hanging means such as standard wire hangers 30 (FIGS. 6–8). The illustrated hanger rod 18 has a circular outer cross-section but other shapes could be utilized.

The attachment members 16 are each generally L-shaped having a horizontal portion and a vertical portion connected by a bend of about ninety degrees. The vertical portions of the attachment members 16 are attached to the end portions 22 of the shelf supports 12 such that the horizontal portions of the attachment members 16 inwardly extend into the ends of the support members 14. The attachment members 16 are preferably fixed to the shelf supports 12 by welding but can be fixed in any other suitable manner such as, for example, mechanical fasteners. The horizontal portions of the attachment members 16 are sized to extend into the ends of the support members 14 to support the support members 14 and the hanger rod 18. The horizontal portions of the attachment members 16 can be attached to the support members 14 by any suitable manner such as, for example, welding or mechanical fasteners.

FIG. 6 illustrates a movable aisle garment rack assembly or system 40 according to the invention which has a plurality of storage elements or racks 42, 44, 46, 48, 50. The garment rack system 40 of the illustrated embodiment includes five adjacently positioned racks 42, 44, 46, 48, 50 with a single access passage or aisle 52. It is noted that other quantities of racks can be utilized within the scope of the present invention. When one of the racks 42, 44, 46, 48, 50 is to be approached for loading and/or unloading it may necessary to move the aisle 52 for access to the desired rack. To this end, the two end racks 42, 50 have fixed positions while the three middle racks 44, 46, 48 are laterally movable, leftward and rightward as viewed in FIG. 6, to selectively form the aisle 52 adjacent the desired rack.

The movable racks 44, 46, 48 are provided with wheels (not shown) on the bottoms thereof and tracks or rails 54 are mounted on the floor along which the movable racks 44, 46, 48 can be moved. The end of each movable rack 44, 46, 48 is provided with a handle assembly 56 so that an operator can manually move the movable racks 44, 46, 48 laterally along the rails 54 to selectively open and close the aisle 52 between adjacent racks. Mechanical driving mechanisms, electric motors, or other suitable powered means for moving the movable racks may alternatively be provided.

The first movable rack 42 has a partially closed configuration as best shown in FIG. 7. The rack 42 includes a rectangular enclosure 58 open at each lateral side and generally divided into two compartments. The enclosure 58 is formed by a pair of closed end panels or uprights 60, an open common panel or upright 62, top and bottom shelves 64, and shelf supports 12. It is noted that the enclosure 58 could alternatively have additional common panels 62 and/or shelves 64 to divide the enclosure 58 into more than two compartments.

Each of the end and common uprights 60, 62 have posts 66, 68 on lateral sides thereof. The posts 66, 68 have double walls with key holes 70 punched only on the inner wall such that the outer or exposed walls do not have holes. The posts 66 of the end uprights 60 are generally L-shaped in cross-section with one row of vertically spaced and laterally facing key holes 70 and the posts 68 of the common upright 62 are generally T-shaped in cross-section with two rows of vertically spaced and laterally facing key holes 70. The key holes 70 are sized to accept the rivets 24 (FIGS. 1–5) of the shelf supports 12.

The shelf supports 12 are of the same configuration as those described above for the hanger assembly 10 (FIGS. 1–5) and are attached to the uprights 60, 62 by means of the rivets 24 (FIGS. 1–5) of the shelf supports 12 which are inserted into the key holes 70 of adjacent uprights 60, 62. The end uprights 60 are located at the longitudinal ends of the enclosure 58 and the common upright 62 is located at approximately the longitudinal center of the enclosure 58. Shelf supports 12 are provided at the top and bottom and at each lateral side of the uprights 60, 62 to provide support for the top and bottom shelves 64. The shelves 64 fit over and are supported by the shelf supports 12. The enclosures therefore are assembled without the need for mechanical fasteners.

A plurality of garment supports or inverted shelf supports 12' longitudinally extend between and are supported by the uprights 60, 62. The inverted shelf supports 12' are of the same configuration as self supports described above and are also attached to the uprights 60, 62 by inserting the rivets 24 (FIGS. 1–5) into the key holes 70 of adjacent uprights 60, 62. However, the inverted shelf supports 12' are installed in an inverted or upside down position, that is, the open side of the channel of the central portion 20 (FIGS. 1–5) is facing downward. The central portion 20 (FIGS. 1–5) of the inverted shelf supports 12' is sized and shaped so that selected garments 28 can be easily hung with suitable hanging means such as the illustrated standard wire hangers 30 and easily removed through the open lateral sides of the enclosure 58.

The illustrated rack 44 includes 8 inverted shelf supports 12' (six of which are visible in FIG. 7). Four of the inverted shelf supports 12' are vertically located generally at the top of the enclosure 58 just below the top shelves 64 and laterally located at the open sides of the enclosure 58 and two of the inverted shelf supports 12' are vertically located generally at the center of the enclosure 58 and laterally located at the open sides of the enclosure 58. It is noted that while the illustrated rack 44 utilizes inverted shelf supports 12', garment supports of other configurations could be utilized. Because the inverted shelf supports 12' are removably attached, the vertical locations of the inverted shelf supports 12' can be adjusted and can be added and/or removed.

The vertical length of the uprights 60, 62 is sized such that the garments 28 can be hung from the inverted shelf supports 12' with the hanging means 30 without contacting the lower inverted shelf support 12' or the bottom shelves 64. The lateral length of the uprights 60, 62 is sized such that laterally adjacent inverted shelf supports 12' are adequately spaced to accept the selected garments 28 in a side-by-side manner. As best seen in FIG. 6, approximately one half of each garment 28 laterally extends out of the open sides of the enclosure 58.

The first movable rack 44 also includes a base 70 upon which the enclosure 58 is mounted. As best seen in FIG. 6, the base 70 is provided with base extensions 72 that laterally extend past the lateral sides of the enclosure 58 at least to the outer sides of the garments 28 to space apart the adjacent racks and prevent contact between the garments 28 hanging in adjacent racks or contact between the garments 28 and an adjacent rack. It is noted that other means for spacing open, and/or the partially open racks, and preventing contact of the garments 28 may be utilized such as, for example extensions or stops at other locations or warning sensors.

The first fixed rack 42 is constructed in a similar manner as the first movable rack 44 except that it is not laterally movable along the rails 54 and therefore is not provided with a handle assembly 56. The outside face of the first fixed rack 42 illustrates that additional inverted shelf supports 12' (FIG. 7) can be utilized to provide a relatively smaller spacing between vertically adjacent garment supports so that shorter garments 28 can be efficiently stored. The first fixed rack also illustrates that an unequal number of inverted shelf supports 12' can be utilized on the two sides of the same rack.

The third movable rack 48 has a fully closed configuration as best shown in FIG. 8 wherein the garments 28 are fully within the enclosure 58. The third movable rack includes two laterally adjacent enclosures 58 which are constructed in the same manner as the enclosure 58 described above. The enclosures 58 of the third movable rack 48 also illustrate that a closed common upright 62' can be utilized. The lateral length of the uprights 60, 62 is sized such that the selected garments 28 do not laterally extend out of the open lateral sides of the enclosures 58 to protect the garments 28, as best seen in FIG. 6. The third movable rack 48 also includes a base 70 upon which the enclosures 58 are mounted. As best seen in FIG. 6, the lateral length of the base 70 is generally equal to the combined lateral length of the two enclosures 58. It is noted that the rack 48 could include doors to selectively close off the open lateral sides or access sides of the enclosures 58.

A plurality of the hanger assemblies 10 are provided within the rack 48. The illustrated rack 48 includes four hanger assemblies within each enclosure 58 for a total of eight hanger assemblies 10. Within each enclosure, one hanger assembly 10 is vertically located generally at the top of the enclosure 58 just below the top shelves 64 and another hanger assembly 10 is vertically located generally at the center of the enclosure 58. As noted above, any number of hanger assemblies 10 can be provided within each enclosure 58 or compartment of the enclosures 58 to provide different spacings.

The shelf supports 12 of the hanger assemblies 10 are attached to the uprights 60, 62 as described above for the shelf supports 12 of the shelves 64. Attached in this manner, the hanger rods 18 longitudinally extend within the enclosures at approximately the lateral center of the enclosures 58. Because the hanger assemblies 10 are removably attached, the vertical locations of the hanger assemblies 10 can be adjusted and hanger assemblies 10 can be added and/or removed. Additional shelves 64 are selectively supported by the shelf supports 12 of the hanger assemblies 10 to provide additional storage space for items above the hanger rods 18.

As best shown in FIG. 6, the second movable rack 46 has a partially closed configuration on a side facing the first movable rack 44 and a closed configuration on a side facing the third rack 48. The second movable rack 46 is constructed in a similar manner as described above for the first and third movable racks 44, 48 except that it is nonuniform about a central longitudinal plane wherein it is constructed in a similar manner as the first movable rack 44 on one side and constructed in a similar manner as the third movable rack 46 on the other side.

The second fixed rack 50 is constructed in a similar manner as one half of the third movable rack 48 except that it is not laterally movable along the rails 54 and therefore is not provided with a handle assembly 56. The second fixed rack 50 illustrates that the lateral length can be sized for a single hanger assembly 10, that is, there is only one enclosure 58 in the lateral direction. This configuration is particularly efficient where the end of the rack system 40 is adjacent a wall.

It is noted that while the illustrated garment rack system 40 includes racks 42, 44, 46, 48, 50 which each have a different configuration, the garment rack system 40 can have racks which all have the same configuration or any quantity of each of the configurations. It is further noted that while the features of each rack configuration may have been described only for that configuration, each of the configurations can be modified to include any of the features of the other rack configurations.

Although particular embodiments of the invention have been described in detail, it will be understood that the invention is not limited correspondingly in scope, but includes all changes and modifications coming within the spirit and terms of the claims appended hereto.

What is claimed is:

1. A movable aisle rack system for storing hanging garments, said movable aisle rack system comprising:

a plurality of laterally movable racks;

enclosures mounted on said movable racks, each of said enclosures having at least one generally horizontal top panel and at least two generally vertical end panels;

posts extending upwardly from each rack and arranged to define opposed pairs of the posts;

hanger assemblies each including a hanger rod for supporting the garments, the hanger rod extending between a pair of support members, each support member being supported by a pair of the posts such that the garments are stored at least partially within said enclosures.

2. The movable aisle rack system as set forth in claim 1, wherein said hanger rods are longitudinally extending on said movable racks between said end panels.

3. The movable aisle rack system as set forth in claim 1, wherein said enclosures have open lateral sides.

4. The movable aisle rack system as set forth in claim 3, wherein said hanger rods are located such that the garments supported by said hanging rods partially extend out said open lateral sides of said enclosures.

5. The movable aisle rack system as set forth in claim 4, wherein said hanger rods are located generally at said open lateral sides.

6. The movable aisle rack system as set forth in claim 4, further comprising fixed means for spacing said movable racks to prevent contact of the garments laterally extending out of said enclosures with an adjacent rack.

7. The movable aisle rack system as set forth in claim 1, wherein said hanger rods are located such that the garments supported by said hanging rods are completely within said enclosure.

8. The movable aisle rack system as set forth in claim 1, wherein said hanger rods are located at approximately the lateral center of said enclosure.

9. The movable aisle rack system as set forth in claim 1, wherein the support members are parallel and spaced apart, said hanger rod being perpendicular to and extending between said supports with ends of said hanger rod being supported by said support members, and each hanger assembly includes a pair of parallel and spaced apart shelf supports perpendicular to and extending between said support members with ends of said support members being supported by said shelf supports, and attachment members for supporting said support members to said shelf supports.

10. The movable aisle rack system as set forth in claim 9, wherein said hanger rods is located at a center portion of said support members and said pair of shelf supports are located at opposite end portions of said support members.

11. The movable aisle rack system as set forth in claim 9, wherein said support members are downwardly opening channels.

12. The movable aisle rack system as set forth in claim 11, wherein said attachment members each have a horizontal portion extending into an end of said support members and a vertical portion attached to said shelf supports.

13. A hanger assembly for a rack system to store hanging garments, said hanger assembly comprising:

a pair of parallel and spaced apart support members;

a garment support perpendicular to and extending between said support members with ends of said garment support being supported by said support members;

a pair of parallel and spaced apart shelf supports perpendicular to and extending between said support members with ends of said support members supported by said shelf supports; and projections provided at ends of the shelf supports and adapted for being received in key holes.

14. The hanger assembly as set forth in claim 13, wherein said garment support is located at a center portion of said support members and said pair of shelf supports are located at opposite end portions of said support members.

15. The hanger assembly as set forth in claim 13, wherein said support members are downwardly opening channels.

16. The hanger assembly as set forth in claim 13, further comprising attachment members each having a horizontal portion extending into an end of said support members and a vertical portion attached to said shelf supports.

17. The movable aisle rack system as set forth in claim 1, wherein each of the posts has a plurality of key holes therein and projections provided at ends of the support members and adapted for being received in the key holes.

18. The movable aisle rack system as set forth in claim 6, wherein the rack includes a base defining the means for spacing, wherein the end panels and posts are supported on the base.

19. The movable aisle rack system as set forth in claim 18, wherein the posts are supported along edges of the end panels.

* * * * *

UNITED STATES PATENT AND TRADEMARK OFFICE

CERTIFICATE OF CORRECTION

PATENT NO. : 5,651,469

DATED : July 29, 1997

INVENTOR(S) : Reginald A. Lodge

It is certified that error appears in the above-identified patent and that said Letters Patent is hereby corrected as shown below:

Col. 4, line5, the "8" should not be on bold.

Claim 10, line 2, "rods" should be --rod--.

Signed and Sealed this

Fourteenth Day of July, 1998

Bruce Lehman

*Attest:*

BRUCE LEHMAN

*Attesting Officer*

*Commissioner of Patents and Trademarks*